US011618178B2

(12) United States Patent
Raichart

(10) Patent No.: US 11,618,178 B2
(45) Date of Patent: Apr. 4, 2023

(54) STEEL BELTED CONVEYOR FOR TRIMMING DRIED CANNABIS FLOWERS

(71) Applicant: Cullen Raichart, San Diego, CA (US)

(72) Inventor: Cullen Raichart, San Diego, CA (US)

( * ) Notice: Subject to any disclaimer, the term of this patent is extended or adjusted under 35 U.S.C. 154(b) by 0 days.

(21) Appl. No.: 17/307,897

(22) Filed: May 4, 2021

(65) Prior Publication Data

US 2022/0355500 A1 Nov. 10, 2022

(51) Int. Cl.
*B26D 3/24* (2006.01)
*B26D 7/06* (2006.01)

(52) U.S. Cl.
CPC ..... *B26D 3/24* (2013.01); *B26D 7/0625* (2013.01)

(58) Field of Classification Search
CPC ... B26D 1/12; B26D 5/22; B26D 1/16; B26D 2210/02; B26D 7/0625; B26D 5/16; B26D 3/26; B26D 7/01; B26D 1/45; B26D 5/08; B26D 31/18; A23N 15/003; A23N 15/04; Y10T 83/6569; Y10T 83/6544
USPC ..... 83/241, 416, 404.3, 409.2, 425.1, 407, 83/408; 99/47, 642, 643, 635, 638, 639
See application file for complete search history.

(56) References Cited

U.S. PATENT DOCUMENTS 2,481,947 A * 9/1949 Philkoff ..... A01F 11/06 99/635
3,653,418 A * 4/1972 Oldershaw ..... A23N 15/04 99/639
3,886,858 A * 6/1975 Evans ..... A23N 15/04 426/518
4,168,642 A * 9/1979 Evans ..... A23N 15/003 83/404.3
5,470,602 A * 11/1995 Cecil ..... A23N 15/003 99/635
5,865,111 A * 2/1999 Hanson ..... A23N 15/04 99/635

FOREIGN PATENT DOCUMENTS

WO WO 2004/030475 A2 * 4/2004 ..... A23N 15/003

* cited by examiner

*Primary Examiner* — Ghassem Alie
(74) *Attorney, Agent, or Firm* — Buche & Associates, P.C.; John K. Buche; Bryce A. Johnson

(57) ABSTRACT

In a preferred embodiment, the apparatus comprises: (1) a track with specifically designed conveyor blades for cutting; (2) a motor for conveying the conveyor blades over each other; (3) a tumble blade to gently move or tumble the flowers over the conveyor blade; and, (4) trimmed flower excavation chute for collecting trimmed buds.

19 Claims, 5 Drawing Sheets

STEEL BELTED CONVEYOR FOR TRIMMING DRIED CANNABIS FLOWERS

CROSS-REFERENCE TO RELATED APPLICATIONS

Not applicable.

STATEMENT REGARDING FEDERALLY SPONSORED RESEARCH OR DEVELOPMENT

Not applicable

BACKGROUND OF INVENTION

Field of Invention

This specification describes subject matter in the field of apparatus and related methods of trimming dried plants, including but not limited to *cannabis*.

Background of Invention

*Cannabis* flowers or buds are harvested, dried, and cured to be used by people for various purposes, including medicinal uses. The *cannabis* flower contains the highest volume of psychoactive compounds in the *cannabis* plant. Also, the plant buds may contain non-intoxicating CBD compounds that are of pharmaceutical and medical interest. Cannabidiol (CBD) is one of at least 60 active cannabinoids identified in *cannabis*. It is a major constituent of the plant, accounting for up to 40% of the plant's extract, as a non-psychotropic phytocannabinoid. CBD is considered by some to have a wider scope of medical applications than tetrahydrocannabinol (THC). In contrast, *cannabis* leaves contain only trace amounts of psychoactive and other compounds, and usually will go to compost. *Cannabis* flowers have traditionally been hand trimmed to remove the unwanted leafy matter, leaving only the flowers. Typically, hand trimming is done by cutting the leaves off with scissors. The hand trimming of *cannabis* flowers is time consuming and tedious. Additionally, hand trimming requires skilled labor. Typically, it takes a skilled trimmer about eight to ten hours to trim one pound of *cannabis*. Trimming at this speed may be feasible for small scale growers, but for larger growers, hand trimming is impractical and can become expensive if the grower must hire outside help.

One solution to hand trimming has been use of machines that automatically trim the plants. These machines can typically trim the same amount of *cannabis* in one hour that an individual worker can trim in one day. Existing automated methods are designed to trim the flowers while they are freshly harvested or "wet." Wet trimming involves violent action that damages the buds and removes resin glands. The wet trimming action reduces the quality of the end by reducing potency and not allowing proper drying and curing. Furthermore, when buds are trimmed wet, the residue from the buds can leave a sticky mess on a trimmer, necessitating constant cleaning of a trimmer machine. Trimming the *cannabis* flower when wet reduces potency, appearance and quality.

The alternative to trimming freshly harvested buds is to trim buds that have been dried. Trimming dry buds produces a better smell and flavor. Drying and curing of the *cannabis* flower is essential to the value and quality of the end product. Trimming of dry *cannabis* requires a gentle action that does not damage the product. Most trimmers utilize blades that rotate at a high speed. This high speed rotation is not suitable for trimming dried *cannabis* plants. Currently no reliable apparatus of automated trimming of dry *cannabis* is known.

In light of the foregoing, a need exists for a device that automates the trimming of dried *cannabis* in such a way that it is not damaged in appearance, potency or overall quality.

SUMMARY OF THE INVENTION

With the aforementioned in mind, it is an object of this description to disclose a device that trims dried *cannabis* flowers in a gentle yet effective manner. It is further an objective to disclose apparatus and related methods of trimming *cannabis* flowers without the drawbacks of heretofore known apparatus. Yet still, it is an objective to disclose apparatus and related methods of trimming dried *cannabis* flowers so that a higher quality *cannabis* flower can be used for recreational or medicinal purposes. In a preferred embodiment, the apparatus comprises: (1) a track with specifically designed conveyor blades for cutting; (2) a motor for conveying the conveyor blades over each other; (3) a tumble blade to gently move or tumble the flowers over the conveyor blade; and, (4) a trimmed flower excavation chute for collecting trimmed buds.

In one mode of operation, dried *cannabis* buds may be put into a feed funnel that direct the buds into the track and onto the conveyor blade. The motor is then turned on to convey the conveyor blade over the stationary blade. Suitably, the conveying of blades creates a scissor action that cuts off the extruding leaves from the buds, while the angled tumble blades stir the flowers so that all sides of the buds are exposed to the scissoring action. As the buds move along the conveyor they are preferably tumbled and cut before the trimmed flowers are deposited in the excavation chute. Once trimmed, the buds may be extracted through the extraction port in the side of the box and more buds may then be added to repeat the cycle.

BRIEF DESCRIPTION OF THE FIGURES

The manner in which these objectives and other desirable characteristics can be obtained is explained in the following description and attached figures in which.

Figure 1:
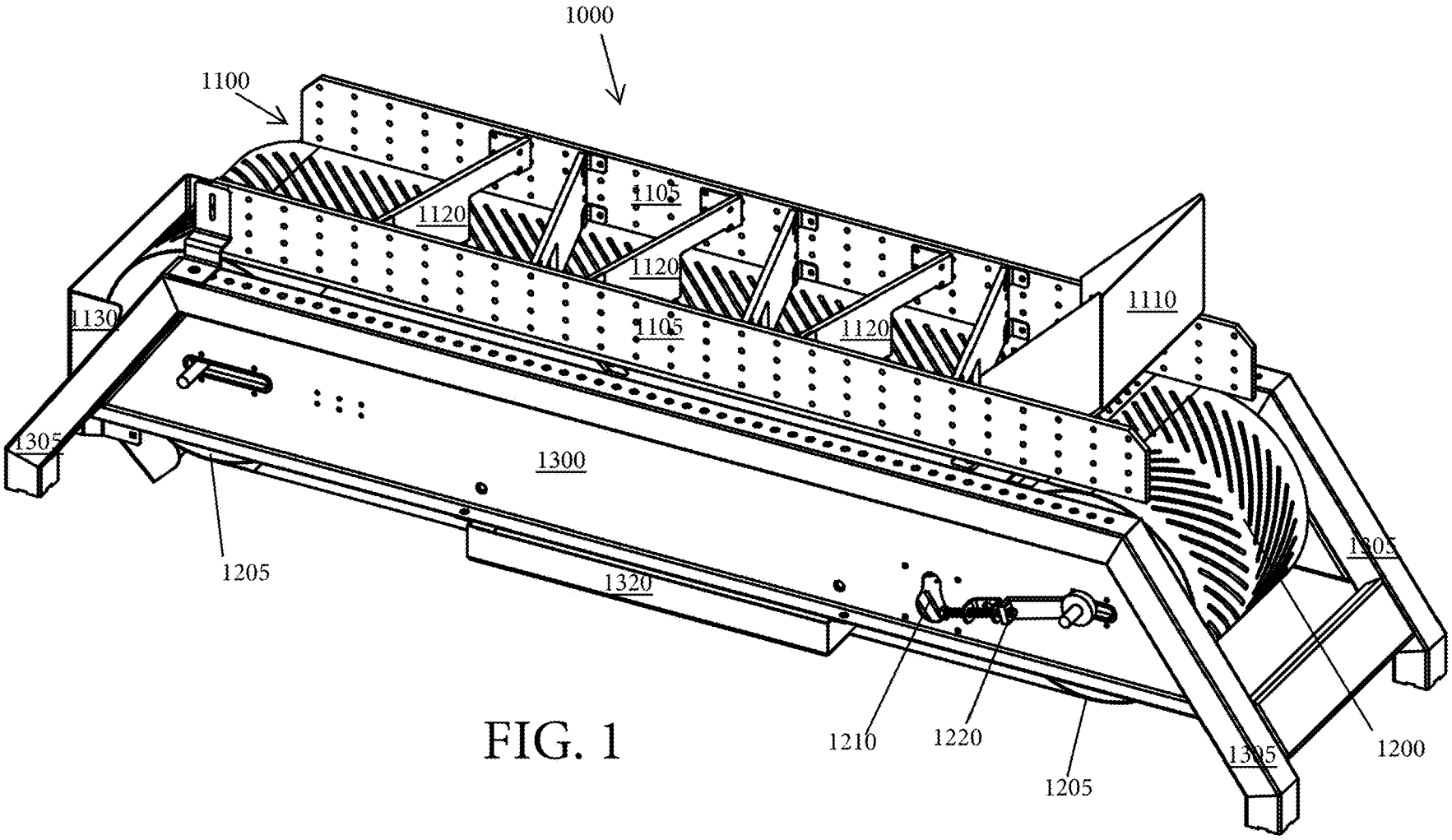
FIG. 1 is a perspective view of a trimmer.

In the figures, the following reference numerals signify the corresponding part of the disclosed Trimmer:

1000—Trimmer
1100—Track
1105—Side Rails
1110—Feed Funnel
1120—Angled Tumble Blades
1130—Trimmed Flower Excavation Chute
1200—Conveyor Blade
1205—Pulley
1206—Pulley Drag
1210—Motor
1220—Power Transmission

1300—Base
1305—Legs
1310—Stationary Blade
1315—Trim Collection Chute
1320—Trim Collection Tray

DETAILED DESCRIPTION OF THE INVENTION

What is generally disclosed may be a steel belted *cannabis* conveyor trimmer. The steel belted conveyor trimmer is a continuously fed trimmer where untrimmed *cannabis* is fed, non-stop, into a feed funnel that guides the flowers or buds for deposit between two side rails and on top of the steel conveyor belt. The belt has several cutting edges that accomplish scissor cutting action across a cooperating stationary blade so that the buds are trimmed as the belt carries the buds from one end of trimmer to the other. Suitably the side rails feature angled tumble blades that tumble the flowers from side to side as they travel down the conveyor track. Ultimately, the buds are trimmed as they travel the length of the conveyor and the trim falls through the stationary blade to a collection tray in the base of the trimmer. The more detailed features of the disclosed conveyor trimmer are described in connection with the figures.

Figure 2:
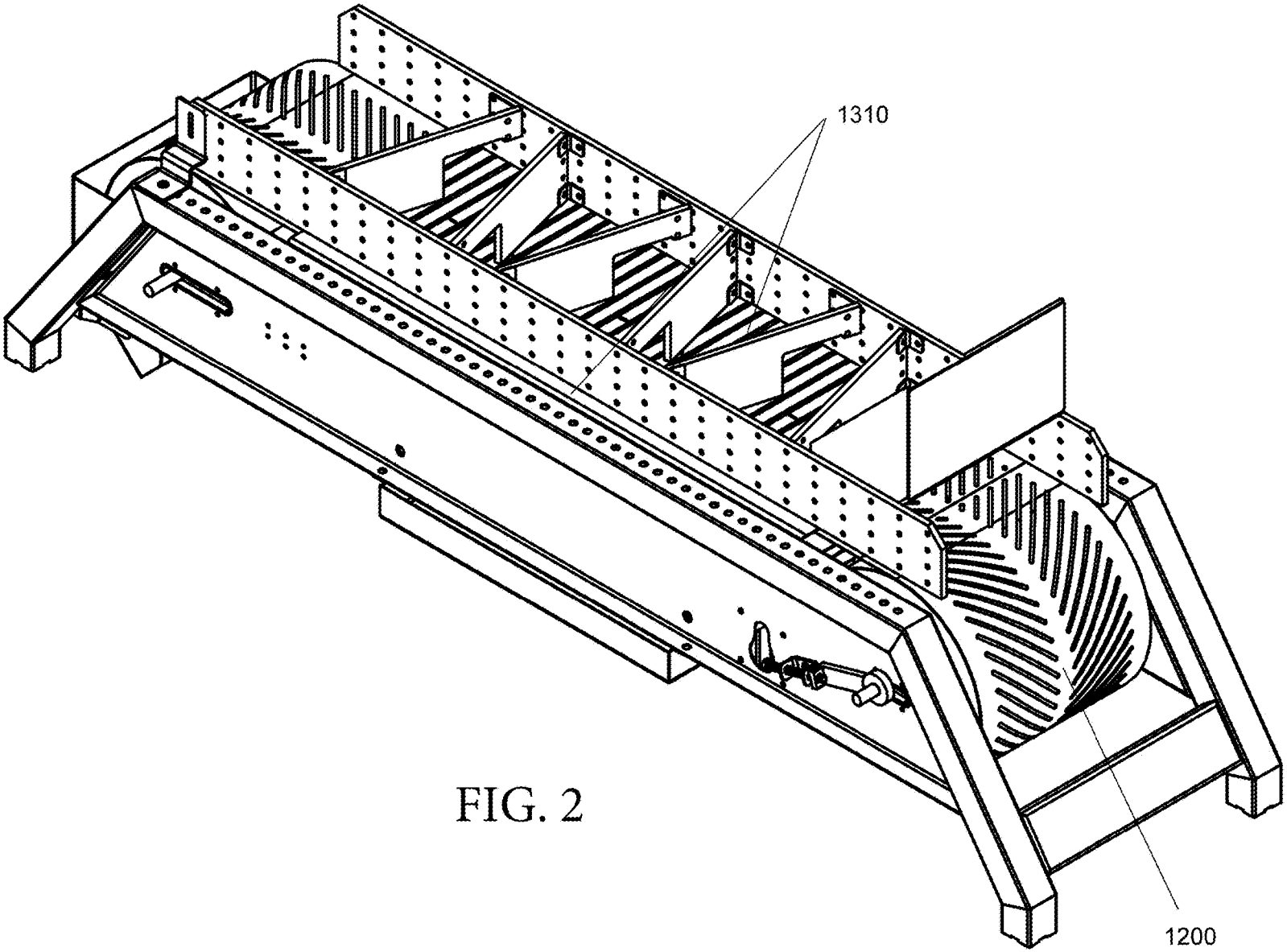
FIG. 2 is another perspective view of the trimmer.
Figure 5:
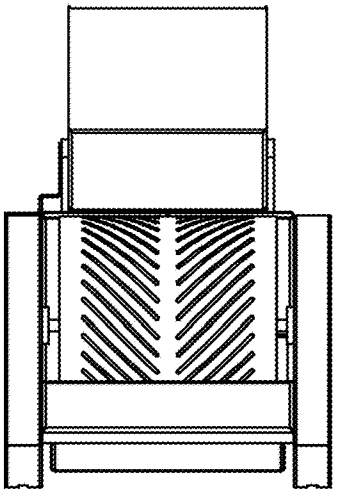
FIG. 5 is a side view of the trimmer.
Figure 3:
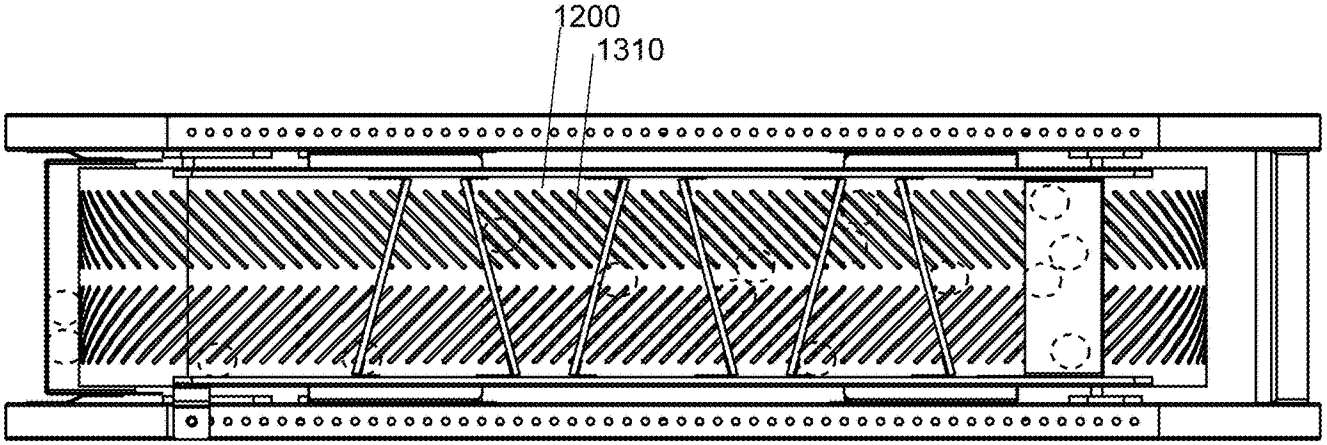
FIG. 3 is a top view of the trimmer.
Figure 4:
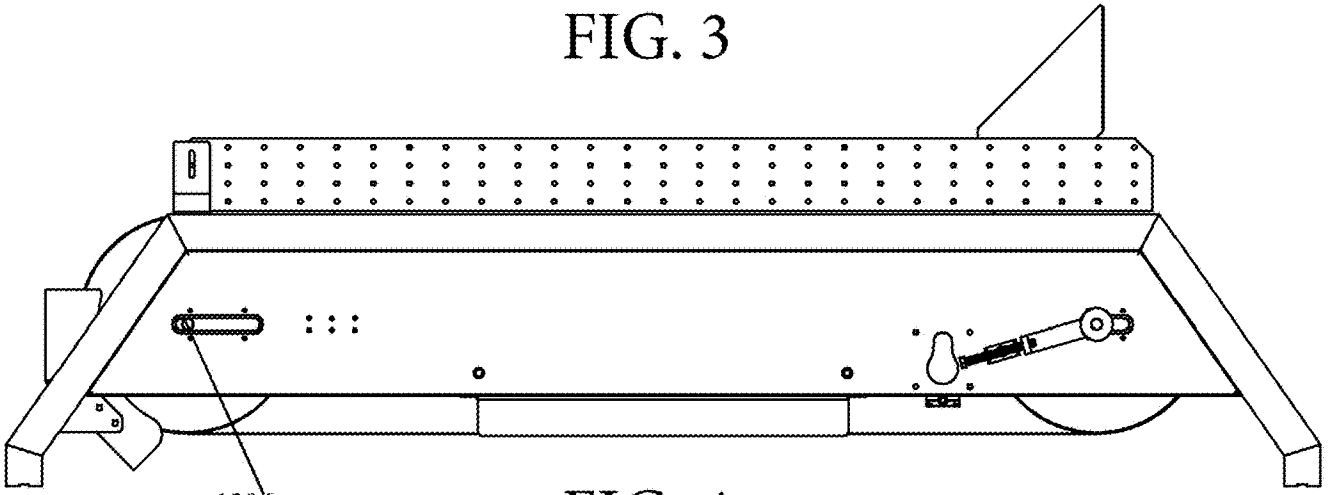
FIG. 4 is a front view of the trimmer.
Figure 9:
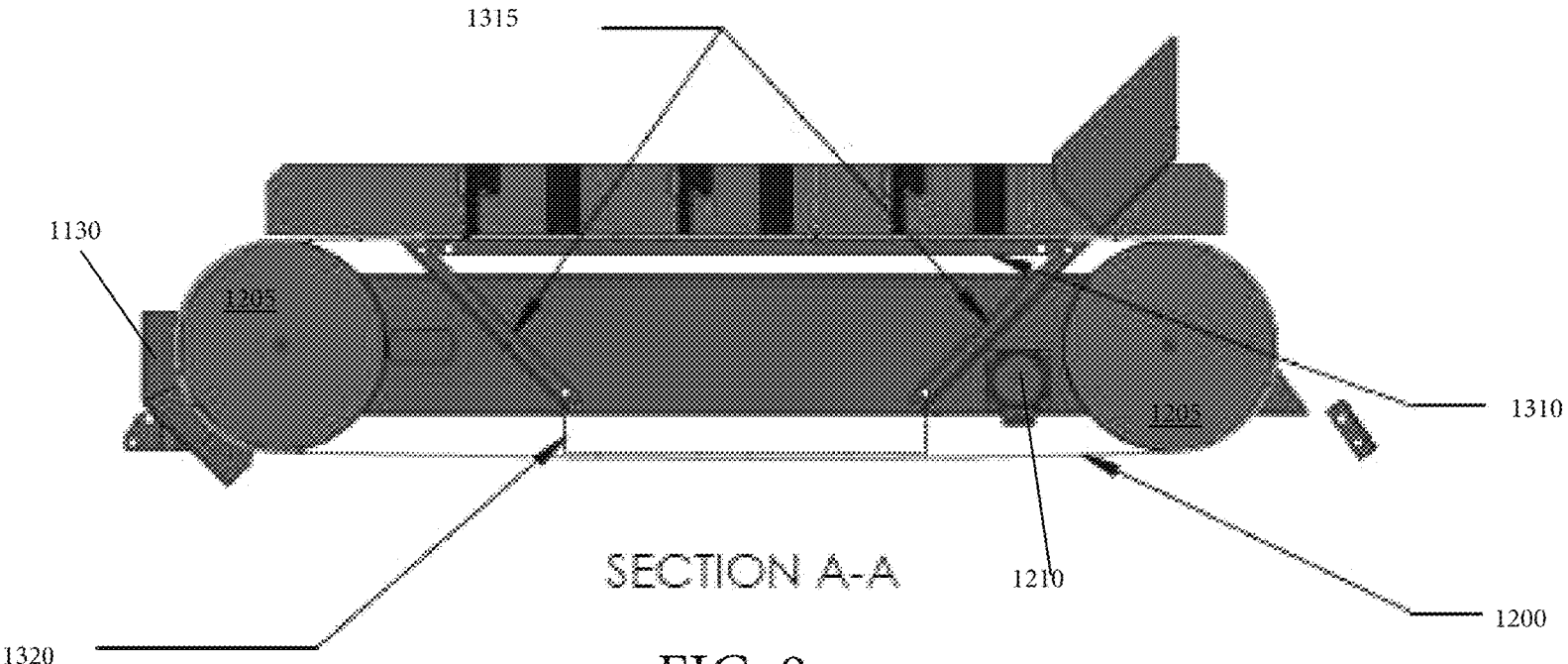
FIG. 9 is a cross-section of the trimmer along line A-A of FIG. 8.
Figure 8:
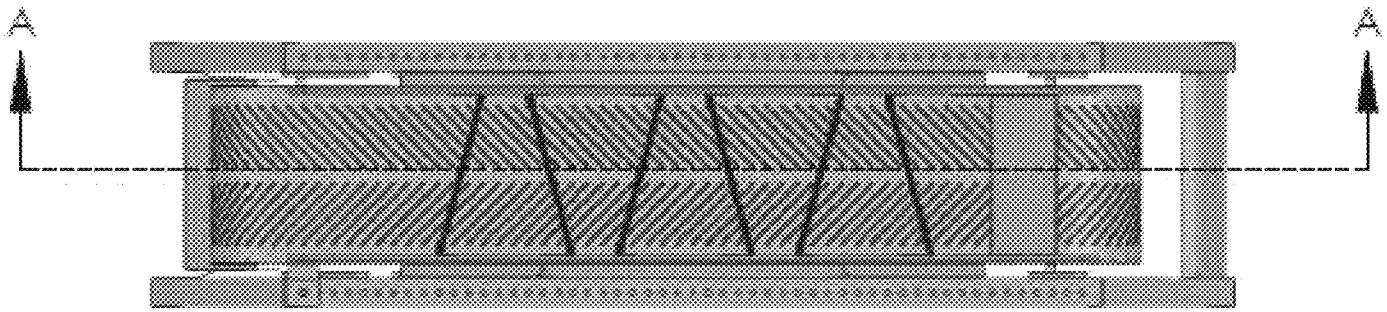
FIG. 8 is another top view of the trimmer.

FIGS. 1 & 2 are perspective views of preferred embodiment of the trimmer 1000. More specifically, FIG. 1 is a standard perspective view of the trimmer 1000 with a conveyor blade 1200 and FIG. 2 is a perspective view of the trimmer 1000 with the conveyor blade 1200 partially cut away so that the stationary blade 1200 is exposed for illustration. FIGS. 3, 4, and 5 are respectively top, front, and side views of the trimmer. FIGS. 8 and 9 are respectively top and cross-section views of the trimmer. As shown, the trimmer 1000 may be defined by a base 1300 with four legs 1395 to uphold a stationary blade (1310, shown in FIGS. 2, 3, 6 and 9) and two pullies for revolving motor-driven conveyor blade 1200 so that the conveyor blade moves over the stationary blade to accomplish a scissor action between a cutting edge of the conveyor blade and a cutting edge of the stationary blade. Suitably, a motor is disposed within the base 1300, wherein the motor features a power transmission line to impart rotary motion onto one of the pullies in order to drive the conveyor blade 1200 when the trimmer is in use. Disposed on the base 1300 are two upright side rails so that buds or plant flowers deposited on to the conveyor blade 1200 may be retained thereon and within a track 1100. In one mode of operation, buds (not shown) may be disposed in between the side rails 1105 via a feed funnel 1110 at one end (see FIG. 5) of the conveyor blade 1200. Preferably, the side rails 1105 feature angled tumble blades 1120 that tumble the flowers from side to side or back and forth as they travel down the conveyor track 1000 toward the opposite end of trimmer for collection at the excavation tray. It should be apparent that, the buds are trimmed as they travel the length of the conveyor via the scissor action of the two blades' cutting edges. Suitably, the trim falls through the stationary blade 1310 (FIGS. 3 6 & 9) and down a collection chute 1315 into a collection tray 1320 in within the base 1300 of the trimmer 1000. The trimmed buds are collected via chuting them down an evacuation chute 1130 into a collection container (not shown).

Figure 6:
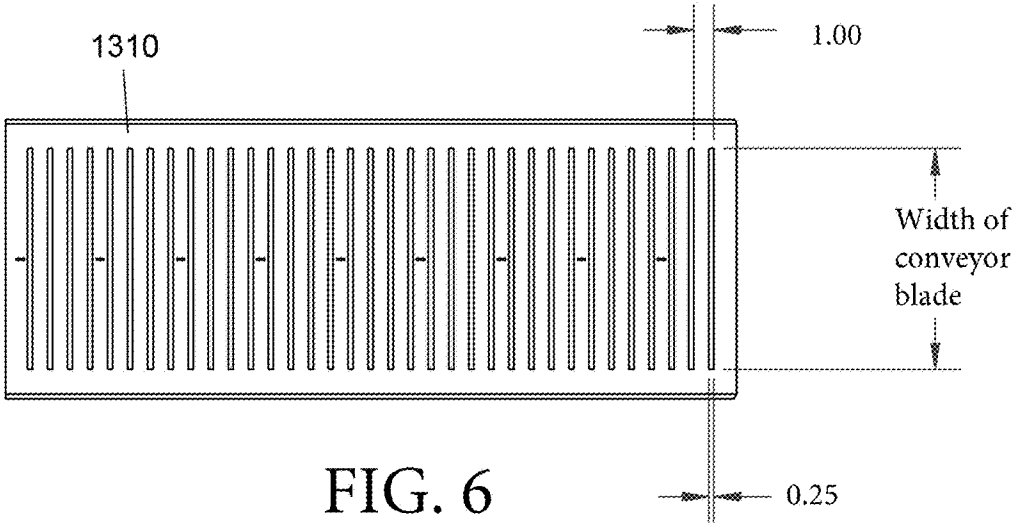
FIG. 6 is a plan view of the stationary blade.

FIG. 6 shows a plan view of the stationary blade 1310. As shown, the blade 1310 suitably features a single row of cut outs that are suitably perpendicular to the blade's side walls. Each cut out defines a cutting surface on the edges. In the preferred embodiment, the cut outs have a 1.00 inch pitch and a 0.25 inch width on the short end. preferably, the cutouts have a width on the long side that is approximately equal to the width of the conveyor blade 1200.

Figure 7:
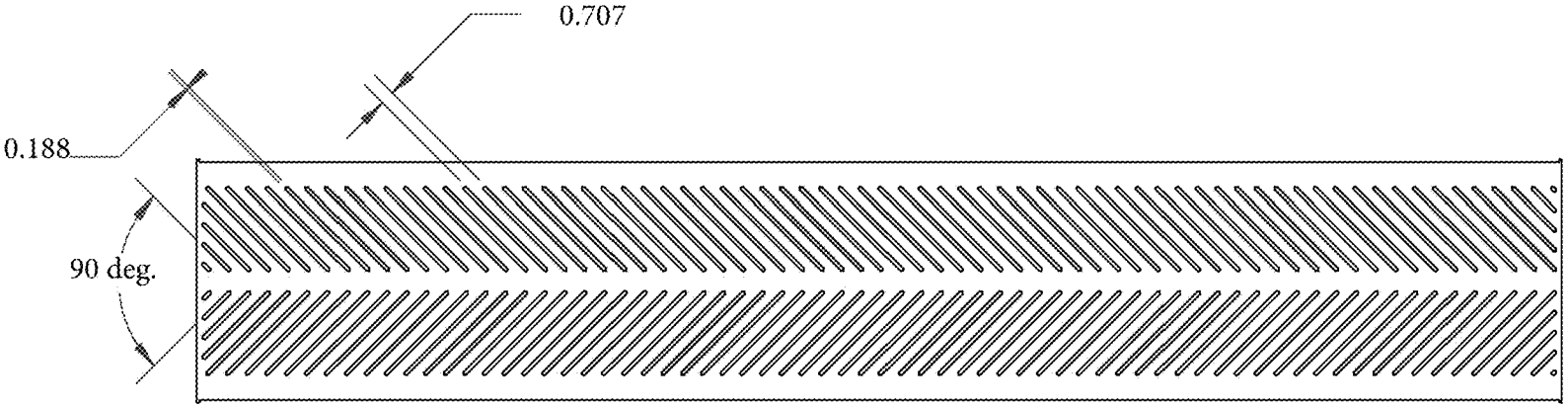
FIG. 7 is a plan view of a conveyor blade.

FIG. 7 shows a plan view of the conveyor blade 1200. As shown, the blade 1200 suitably features two rows of cut outs that are suitably angled at ninety degrees relative to each other. Each cut out defines a cutting surface on the edges. In the preferred embodiment, the cut outs have a 0.707 inch pitch and a 0.188 inch width. Suitably, the conveyor belt 1200 may be a "corrosion resistant steel belt or any other corrosion resistant and non-toxic belt.

Referring to FIGS. 1, 6, 7, and 9, the conveyor blade may be assembled. As shown, the pulleys 1205 may be installed with an axle into the base 1300 and the stationary blade positioned over the trim chute 1315 so that the blade 1310 spans the base 1300 and defines the base's top surface. Next, the conveyor blade may be strung around the two pullies 1205 and then the pulley drag 1206 pulled taut so that the conveyor blade is both taut around the pullies and flush with the stationary cutting blade. The motor 1210 may be secured to a sidewall of the base 1300 and further feature a power transmission for imparting motion to one or more of the pulleys 1205 via their axle. Finally, the upright side walls may be secured to the base to define the track 1000 and the tumble blades may be disposed between the side walls to create a tumble pattern.

In one mode of operation, dried *cannabis* buds may be put into the feed funnel 1110 that direct the buds into the track 1100 and onto the conveyor blade 1200. The motor 1210 may be then turned on to convey the conveyor blade 1200 over the stationary blade 1310. Suitably, the conveying of blades 1200,1310 creates a scissor action that cuts off the extruding leaves from the buds, while the angled tumble blades 1120 stir the flowers side-to-side over the blades so that all surfaces of the buds are exposed to the scissoring action of the blades 1200,1310. As the buds move along the conveyor they are suitably tumbled and cut before the trimmed flowers are harvested via the excavation chute 1130. Once trimmed, the buds' trimmings may be extracted through the extraction port in the side of the box and more buds may then be added to repeat the cycle.

While various embodiments of the method and apparatus have been described above, it should be understood that they have been presented by way of example only, and not of limitation. Likewise, the various diagrams might depict an example of an architectural or other configuration for the disclosed method and apparatus, which is done to aid in understanding the features and functionality that might be included in the method and apparatus. The disclosed method and apparatus is not restricted to the illustrated example architectures or configurations, but the desired features might be implemented using a variety of alternative architectures and configurations. Indeed, it will be apparent to one of skill in the art how alternative functional, logical or physical partitioning and configurations might be implemented to implement the desired features of the disclosed method and apparatus. Also, a multitude of different constituent module names other than those depicted herein might be applied to the various partitions. Additionally, with regard to flow diagrams, operational descriptions and method claims, the order in which the steps are presented herein shall not mandate that various embodiments be implemented to perform the recited functionality in the same order unless the context dictates otherwise.

Although the method and apparatus is described above in terms of various exemplary embodiments and implementations, it should be understood that the various features, aspects and functionality described in one or more of the individual embodiments are not limited in their applicability to the particular embodiment with which they are described, but instead might be applied, alone or in various combinations, to one or more of the other embodiments of the disclosed method and apparatus, whether or not such embodiments are described and whether or not such features are presented as being a part of a described embodiment. Thus the breadth and scope of the claimed invention should not be limited by any of the above-described embodiments.

Terms and phrases used in this document, and variations thereof, unless otherwise expressly stated, should be construed as open-ended as opposed to limiting. As examples of the foregoing: the term "including" should be read as meaning "including, without limitation" or the like, the term "example" is used to provide exemplary instances of the item in discussion, not an exhaustive or limiting list thereof, the terms "a" or "an" should be read as meaning "at least one," "one or more," or the like, and adjectives such as "conventional," "traditional," "normal," "standard," "known" and terms of similar meaning should not be construed as limiting the item described to a given time period or to an item available as of a given time, but instead should be read to encompass conventional, traditional, normal, or standard technologies that might be available or known now or at any time in the future. Likewise, where this document refers to technologies that would be apparent or known to one of ordinary skill in the art, such technologies encompass those apparent or known to the skilled artisan now or at any time in the future.

The presence of broadening words and phrases such as "one or more," "at least," "but not limited to" or other like phrases in some instances shall not be read to mean that the narrower case is intended or required in instances where such broadening phrases might be absent. The use of the term "module" does not imply that the components or functionality described or claimed as part of the module are all configured in a common package. Indeed, any or all of the various components of a module, whether control logic or other components, might be combined in a single package or separately maintained and might further be distributed across multiple locations.

Additionally, the various embodiments set forth herein are described in terms of exemplary block diagrams, flow charts and other illustrations. As will become apparent to one of ordinary skill in the art after reading this document, the illustrated embodiments and their various alternatives might be implemented without confinement to the illustrated examples. For example, block diagrams and their accompanying description should not be construed as mandating a particular architecture or configuration. All of the claims as originally filed are hereby incorporated into this specification by reference.

The invention claimed is:

1. A method of trimming dried plants comprising:

obtaining a device featuring:

a conveyor blade defined by at a row of elongated openings in a conveyor belt wherein each opening of the elongated openings of the conveyor blade is angled relative to a side wall of the conveyor belt; and, a stationary blade defined by a row of elongated cut outs through a plate, wherein the stationary blade is underneath the first blade and wherein each cut out of the stationary blade is perpendicular to a side wall of the plate;

a container housing the conveyor blade over the stationary blade, said container featuring side rails that define a track; and, a motor connected to a pulley for the conveyor blade;

placing, via a feed funnel, plants to be trimmed on top of the conveyor blade between the side rails and within the track;

turning on the motor so that the motor spins the pulley and conveys the conveyor blade over the stationary blade while the stationary blade remains stationary, so that the plants are conveyed along the track, and so that an extrusion of at least one of the plants is provided through one of the openings of the conveyor blade and one of the cut outs of the stationary blade;

continuing to run the motor so that the conveyor blade is further conveyed over the stationary blade until a cutting action is accomplished at least between an edge of said one of the openings of the conveyor blade and an edge of said one of the cut outs of the stationary blade whenever said edges intersect during conveying of the conveyor blade over the stationary blade;

allowing said cutting action to trim the extrusion off of the one plant so that the trimmed extrusion falls through the one opening and the one cut out; and, continuing to run the motor so that the conveyor blade is further conveyed over the stationary blade and so that the one plant is conveyed to an extraction chute.

2. The method of trimming dried plants of claim 1 further comprising, prior to the one plant being conveyed to the extraction chute, the steps of:

continuing to run the motor so that the one plant is conveyed to contact with a tumble blade;

continuing to run the motor so that the one plant is conveyed along a tumble pattern defined by the track and the tumble blade, wherein the one plant is tumbled at least once on top of the conveyor blade.

3. The method of claim 2 wherein the tumble pattern is at least in part laid out side-to-side relative to the side rails.

4. The method of claim 3 wherein further comprising, subsequent to the one plant being tumbled at least once on top of the conveyor blade and prior to the one plant being conveyed to the extraction chute, the steps of:

Continuing to run the motor so that the conveyor blade is further conveyed over the stationary blade while the stationary blade remains stationary, so that the plants are conveyed along the track, and so that an extrusion of a different one of the plants is provide through a different one of the openings of the conveyor blade and a different one of the cut outs of the stationary blade;

continuing to run the motor so that the conveyor blade is further conveyed over the stationary blade until a different cutting action is accomplished at least between an edge of the different one of the openings of the conveyor blade and an edge of said different one of the cut outs of the stationary blade whenever said edges intersect during conveying of the conveyor blade over the stationary blade;

allowing said cutting action to trim the extrusion off of the different one of the plants so that the trimmed extrusion falls through the different one opening and the different one cut out; and, continuing to run the motor so that the conveyor blade is further conveyed over the stationary blade and so that the different one of the plants is conveyed to the extraction chute.

5. The method of claim 4 wherein the openings of the conveyor blade have a pitch of about 0.707 inches.

6. The method of claim 5 wherein the cut outs of the stationary blade have a pitch of about 1.00 inch.

7. The method of claim 6 wherein the openings of the conveyor blade have a width of about 0.188 inches.

8. The method of claim 7 wherein the cut outs of the stationary blade have a width of about 0.25 inches.

9. The method of claim 8 wherein the conveyor blade is defined by a second row of elongated openings in the conveyor belt wherein each opening of the second row of elongated openings is angled relative to a side wall of the conveyor belt.

10. The method of claim 8 wherein one opening of the second row is angled relative to an opening of the first row by 90 degrees.

11. A method of trimming dried plants comprising:

obtaining a device featuring:

a conveyor blade defined by two rows of elongated openings wherein each opening of the first row of elongated openings is angled relative to an adjacent elongated opening of the second row of elongated openings;

a stationary blade defined by a single row of elongated cut outs that are each perpendicular to a side wall of the stationary blade;

a container housing the conveyor blade over the stationary blade, said container featuring side rails and at least one tumble blade that define a tumble pattern along a track between the side rails; and, a motor connected to a pulley for the conveyor blade;

placing plants to be trimmed on top of the conveyor blade between the side rails and within the track;

turning on the motor so that the motor spins the pulley and conveys the conveyor blade over the stationary blade, so that the plants are conveyed along the track, and so that an extrusion of one of the plants is provided through one of the openings of either row of openings of the conveyor blade and one of the cut outs of the stationary blade;

continuing to run the motor so that the conveyor blade is further conveyed over the stationary blade until a scissor action is accomplished at least between an edge of said one of the openings of the conveyor blade and an edge of said one of the cut outs of the stationary blade whenever said edges intersect during conveying of the conveyor blade over the stationary blade;

allowing said scissor action to trim the extrusion off of the one plant so that the trimmed extrusion falls through the one opening and the one cut out; and, continuing to run the motor so that the conveyor blade is further conveyed over the stationary blade and so that the one plant is conveyed to an extraction chute.

12. The method of trimming dried plants of claim 11 further comprising, prior to the one plant being conveyed to the extraction chute, the steps of:

continuing to run the motor so that the one plant is conveyed to contact with the tumble blade;

continuing to run the motor so that the one plant is conveyed along the tumble pattern, wherein the one plant is tumbled at least once on top of the conveyor blade.

13. The method of claim 12 wherein the tumble pattern is at least in part laid out side-to-side relative to the side rails.

14. The method of claim 13 wherein further comprising, subsequent to the one plant being tumbled at least once on top of the conveyor blade and prior to the one plant being conveyed to the extraction chute, the steps of:

Continuing to run the motor so that the conveyor blade is further conveyed over the stationary blade while the stationary blade remains stationary, so that the plants are conveyed along the track, and so that an extrusion of a different one of the plants is provide through a different one of the openings of the conveyor blade and a different one of the cut outs of the stationary blade;

continuing to run the motor so that the conveyor blade is further conveyed over the stationary blade until a different scissor action is accomplished at least between an edge of the different one of the openings of the conveyor blade and an edge of said different one of the cut outs of the stationary blade whenever said edges intersect during conveying of the conveyor blade over the stationary blade;

allowing said different scissoring action to trim the extrusion off of the different one of the plants so that the trimmed extrusion falls through the different one opening and the different one cut out; and, continuing to run the motor so that the conveyor blade is further conveyed over the stationary blade and so that the different one of the plants is conveyed to the extraction chute.

15. The method of claim 14 wherein the openings of the conveyor blade have a pitch of about 0.707 inches.

16. The method of claim 15 wherein the cut outs of the stationary blade have a pitch of about 1.00 inch.

17. The method of claim 16 wherein the openings of the conveyor blade have a width of about 0.188 inches.

18. The method of claim 17 wherein the cut outs of the stationary blade have a width of about 0.25 inches.

19. A method of trimming dried plants comprising:

obtaining a device featuring:

a conveyor blade defined by two rows of elongated openings wherein each opening of the first row of elongated openings is angled relative to an adjacent elongated opening of the second row of elongated openings;

a stationary blade defined by a single row of elongated cut outs that are each perpendicular to a side wall of the stationary blade;

a container housing the conveyor blade over the stationary blade, said container featuring side rails and a plurality of tumble blades that define a tumble pattern along a track between the side rails; and, a motor connected to a pulley for the conveyor blade;

placing plants to be trimmed on top of the conveyor blade between the side rails and within the track;

turning on the motor so that the motor spins the pulley and conveys the conveyor blade over the stationary blade, so that the plants are conveyed along the track, and so that extrusions of the plants are provided through more than one of the openings of the conveyor blade and more than one of the cut outs of the stationary blade;

continuing to run the motor so that the conveyor blade is further conveyed over the stationary blade until a scissor action is accomplished at least between an edge of said one of the openings of the conveyor blade and an edge of said one of the cut outs of the stationary blade whenever said edges intersect during conveying of the conveyor blade over the stationary blade;

allowing said scissor action to trim the extrusions off of the plants so that the trimmed extrusions falls through the openings and cut outs; and, continuing to run the motor so that the conveyor blade is further conveyed over the stationary blade and so that the one plant is conveyed to an extraction chute.

* * * * *